US007114664B2

(12) United States Patent
Gundersen et al.

(10) Patent No.: US 7,114,664 B2
(45) Date of Patent: Oct. 3, 2006

(54) TEXTURE SPRAYER WITH REMOVABLE ENGINE-COMPRESSOR MODULE

(75) Inventors: Robert J. Gundersen, Otsego, MN (US); James C. Schroeder, Ramsey, MN (US); David J. Thompson, Oak Grove, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 11/102,949

(22) Filed: Apr. 11, 2005

(65) Prior Publication Data

US 2005/0230497 A1 Oct. 20, 2005

Related U.S. Application Data

(60) Provisional application No. 60/562,434, filed on Apr. 15, 2004.

(51) Int. Cl.
*B05B 9/00* (2006.01)
*B05B 1/00* (2006.01)

(52) U.S. Cl. ..... 239/149; 239/146; 239/289; 239/332; 239/600; 239/302; 222/608; 280/47.18; 280/415.1; 417/362

(58) Field of Classification Search ..... 239/149, 239/152, 289, 148, 146, 302, 332, 600; 280/415.1, 280/47.18, 47.34, 47.35, 79.11; 55/356, 55/357; 404/94, 95; 222/608, 609, 610; 417/234, 362, 323; 210/232, 251, 249
See application file for complete search history.

(56) References Cited

U.S. PATENT DOCUMENTS

| | | | | |
|---|---|---|---|---|
| 2,789,756 | A | | 4/1957 | Allen |
| 3,797,743 | A | | 3/1974 | Kommers et al. |
| 4,135,669 | A | * | 1/1979 | Bridges et al. ..... 239/373 |
| 4,408,720 | A | | 10/1983 | Anderson et al. |
| 4,865,255 | A | | 9/1989 | Luvisotto |
| 5,201,638 | A | | 4/1993 | Bieri |
| 5,318,314 | A | * | 6/1994 | Cyphers et al. ..... 280/47.26 |
| 5,368,232 | A | * | 11/1994 | Schroeder ..... 239/165 |
| 5,441,297 | A | * | 8/1995 | Krohn et al. ..... 280/655 |
| 5,538,402 | A | | 7/1996 | McKenney |
| 2002/0131872 | A1 | | 9/2002 | Lucchi |

* cited by examiner

*Primary Examiner*—Dinh Q. Nguyen
(74) *Attorney, Agent, or Firm*—Douglas B. Farrow

(57) ABSTRACT

A texture sprayer is provided with a hopper feeding an air operated double diaphragm pump. The sprayer is provided with a removable power pack which includes a gas engine, an air pump, an air unloading regulator, an air cooler, an air QD and a mounting base with handles. The power pack may be removed from the sprayer cart and located outside so that the sprayer can be used quietly and safely indoors.

2 Claims, 4 Drawing Sheets

TEXTURE SPRAYER WITH REMOVABLE ENGINE-COMPRESSOR MODULE

TECHNICAL FIELD

This application claims the benefit of U.S. Application Ser. No. 60/562,434, filed Apr. 15, 2004.

BACKGROUND ART

Sprayers for application of texture materials to ceilings and other surfaces are well known.

DISCLOSURE OF THE INVENTION

A texture sprayer is provided with a hopper feeding an air operated double diaphragm pump. The sprayer is provided with a removable power pack which includes a gas engine, an air pump, an air unloading regulator, an air cooler, an air QD and a mounting base with handles. The power pack may be removed from the sprayer cart and located outside so that the sprayer can be used quietly and safely indoors.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

The sprayer 10 of the instant invention is comprised of a main cart 12 having an air operated double diaphragm pump 14 mounted thereon. Pump 14 is fed by a hopper 16. The output of pump 14 is connected to an application device (not shown but conventional in nature).

Figure 4:
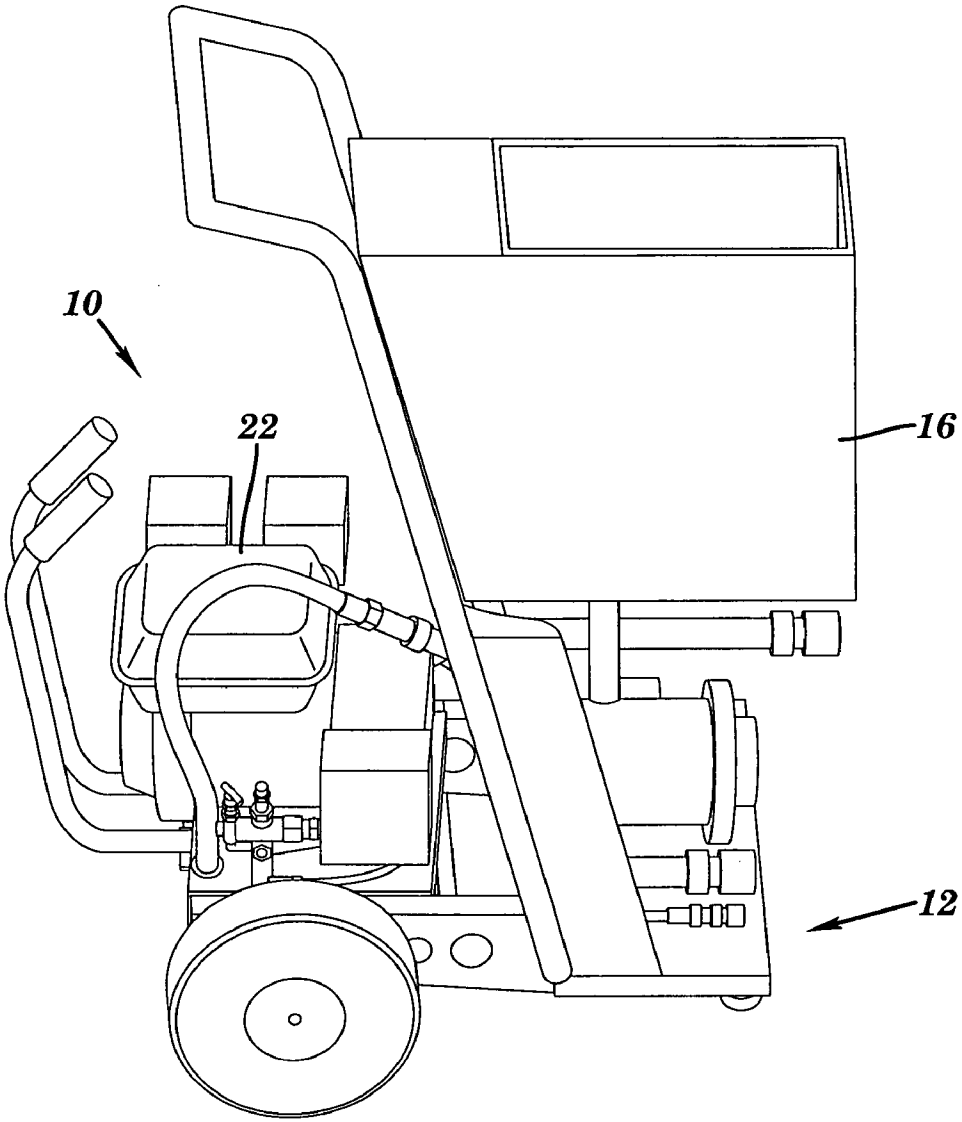
FIG. 4 is a side view showing the power pack installed.

A power pack 18 has a frame 20 and located thereon a gas engine 22, an air pump 24, an air unloading regulator 26, an air cooler 28 and an air QD (quick disconnect) 30. An air hose 32 is used to connect power pack 18 to pump 14 and may be either a longer hose such as that shown in FIG. 1 for remote operation or a short hose such as shown in FIG. 4 for integral operation.

Figure 1:
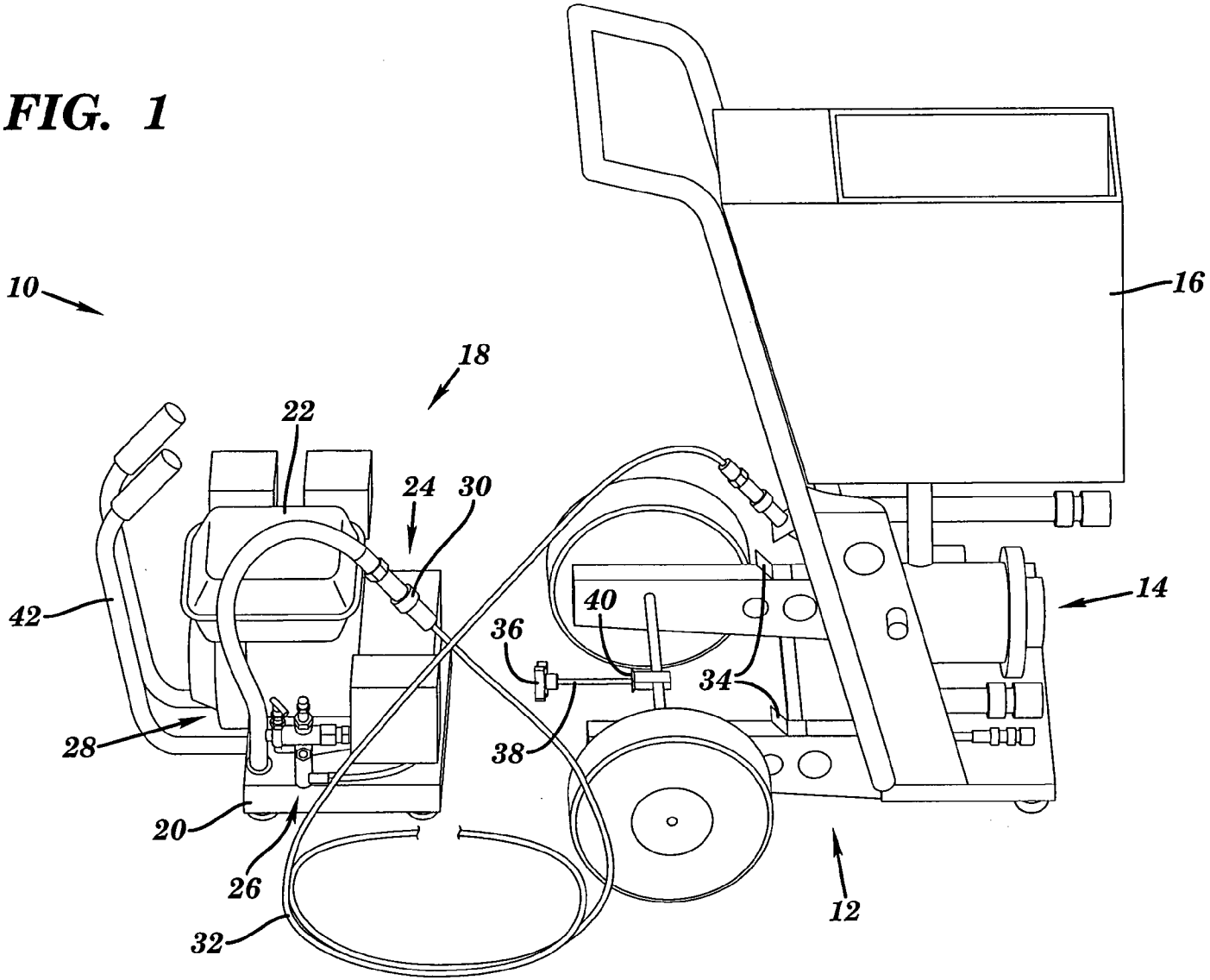
FIG. 1 is a side view showing the power pack separated from the main sprayer.
Figure 2:
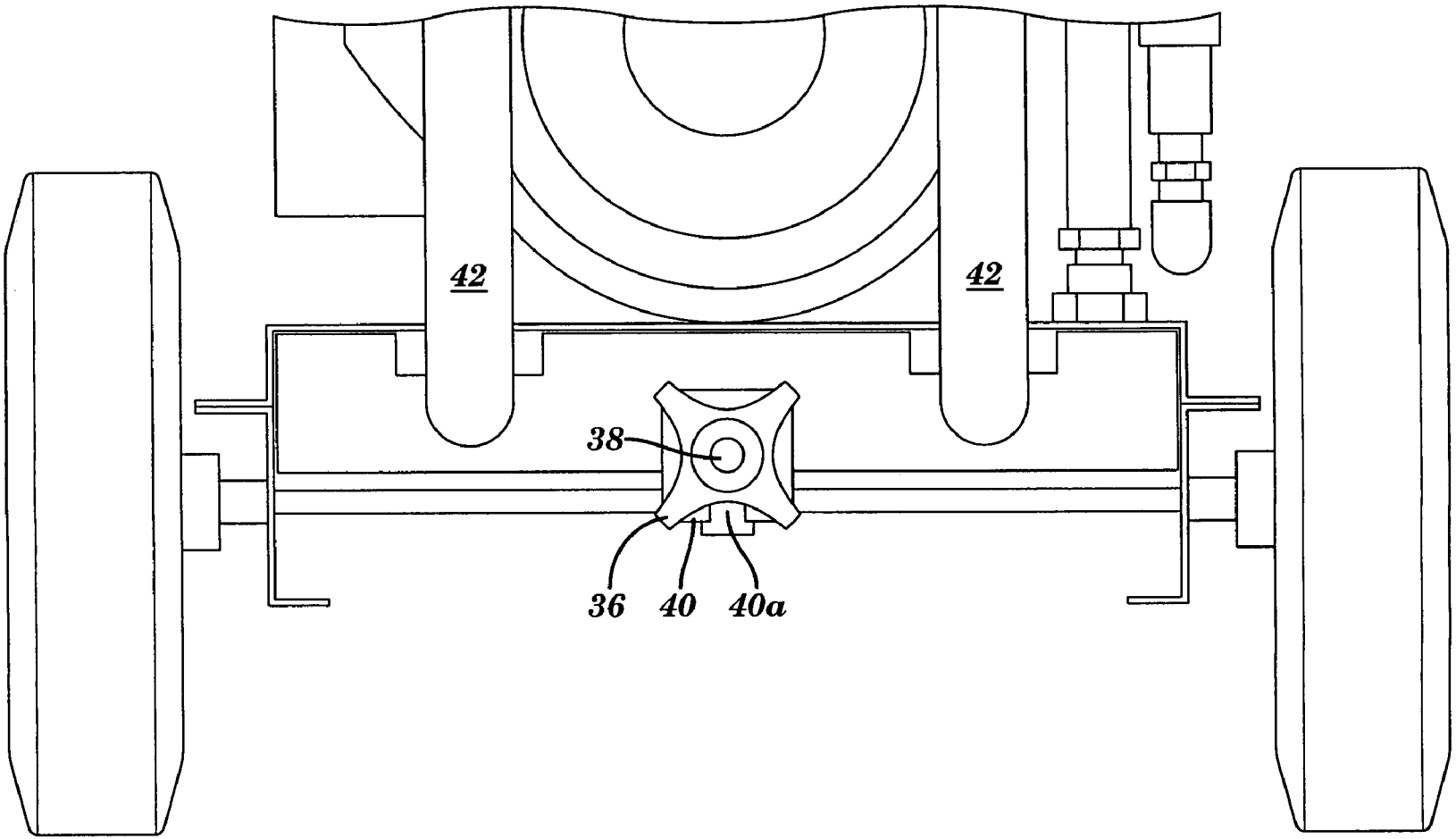
FIG. 2 shows detail of the locking feature.
Figure 3:
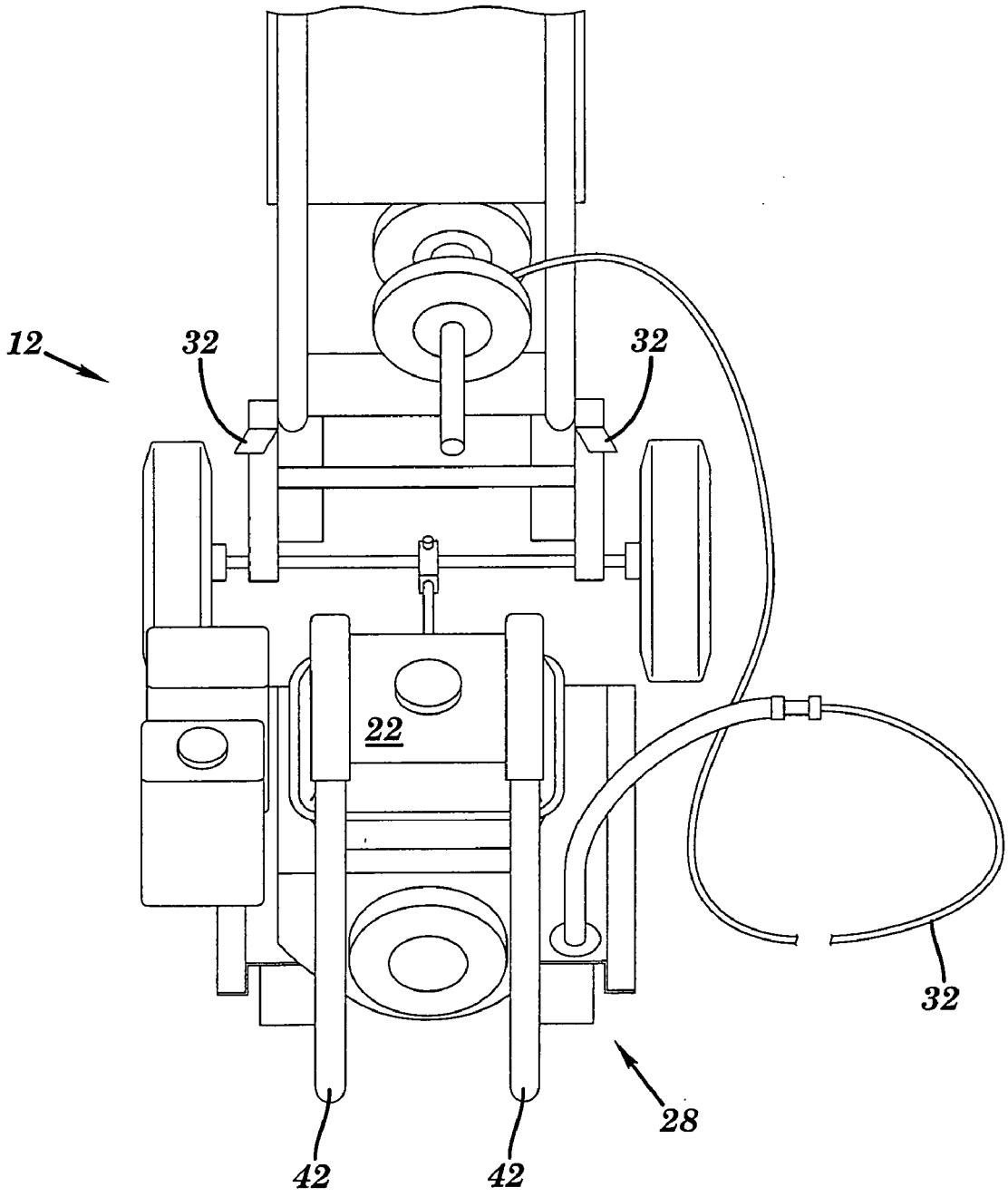
FIG. 3 shows more of the locking feature.

Power pack frame 20 is removable attached to cart 12 by means of a three point lock down mechanism shown in detail in FIGS. 1–3. A pair of tabs 34 are located on cart 12 and receive frame 20. A locking knob 36 is threaded on rod 38 and engages slotted tab 40 on frame 20. To remove power pack 18, first air hose 32 is removed using QD 30. Knob 36 is loosened and lowered from engagement with slot 40*a* in tab 40. The power pack 18 is then lifted via handles 42 and slid rearwardly to disengage frame 20 from tabs 34. Reinstallation of the power pack 18 is simply a reversal of the steps set forth above. Theft lock holes 12*a* and 20*a* are provided in cart 12 and frame 20 respectively for insertion of a lock to prevent theft of the power pack.

It is understood that the lock down mechanism set forth herein is not limited to the specific preferred embodiment but may include any of a number of other art recognized attachment mechanisms such a bolts or other fasteners, clamps and the like.

It is contemplated that various changes and modifications may be made to the texture sprayer without departing from the spirit and scope of the invention as defined by the following claims.

The invention claimed is:

1. A sprayer for application of texture materials, said sprayer comprising:

a cart;

a hopper and an air operated pump connected to said hopper mounted to said cart, said air operated pump being connected so as to pump said texture materials from said hopper;

a power pack designed for separate or integral operation with said cart, said power pack comprising a gas engine and a compressor powered by said engine; and a lock down mechanism for removably attaching said power pack to said cart.

2. The texture sprayer of claim 1 wherein said power pack comprises a frame and wherein said cart has at least one frame engaging member.

* * * * *